US006041704A

United States Patent [19]

Pauschinger

[11] Patent Number: 6,041,704

[45] Date of Patent: Mar. 28, 2000

[54] METHOD FOR OPERATING A DIGITALLY PRINTING POSTAGE METER TO GENERATE AND CHECK A SECURITY IMPRINT

[75] Inventor: Dieter Pauschinger, Hohen Neuendorf, Germany

[73] Assignee: Francotyp-Postalia AG & Co., Birkenwerder, Germany

[21] Appl. No.: 08/987,393

[22] Filed: Dec. 9, 1997

[51] Int. Cl.[7] ..... B41L 47/46

[52] U.S. Cl. ..... 101/91; 400/103; 400/104

[58] Field of Search ..... 705/401–411; 380/21, 51; 101/91; 400/76, 70, 61, 103, 104

[56] References Cited

U.S. PATENT DOCUMENTS

| | | | |
|---|---|---|---|
| 3,962,539 | 6/1976 | Ehrsam et al. . | |
| 4,200,770 | 4/1980 | Hellman et al. . | |
| 4,405,829 | 9/1983 | Rivest et al. . | |
| 4,746,234 | 5/1988 | Harry . | |
| 4,949,381 | 8/1990 | Pastor . | |
| 5,146,500 | 9/1992 | Maurer | 380/30 |
| 5,218,637 | 6/1993 | Angebaud et al. | 380/23 |
| 5,231,668 | 7/1993 | Kravitz . | |
| 5,304,786 | 4/1994 | Pavlidis et al. . | |
| 5,399,846 | 3/1995 | Pavlidis et al. . | |
| 5,504,322 | 4/1996 | Pavlidis et al. . | |
| 5,586,036 | 12/1996 | Pintsov | 364/464.02 |
| 5,606,617 | 2/1997 | Brands | 380/30 |
| 5,680,463 | 10/1997 | Windel et al. . | |
| 5,712,916 | 1/1998 | Windel et al. . | |
| 5,822,739 | 10/1998 | Kara | 705/410 |
| 5,825,880 | 10/1998 | Sudia et al. | 380/21 |
| 5,907,618 | 5/1999 | Gennaro et al. | 380/21 |

FOREIGN PATENT DOCUMENTS

| | | | |
|---|---|---|---|
| 0 154 972 | 9/1985 | European Pat. Off. . | |
| 0 360 225 | 10/1995 | European Pat. Off. . | |
| 0 676 877 | 10/1995 | European Pat. Off. . | |
| 0 676 877 A2 | 11/1995 | European Pat. Off. | 380/21 |
| 0 762 692 | 8/1996 | European Pat. Off. . | |
| 43 39 460 | 4/1995 | Germany . | |
| 195 23 009 | 1/1997 | Germany . | |
| 196 05 014 | 3/1997 | Germany . | |

OTHER PUBLICATIONS

A PDF 417 Primer, Itkin et al., Symbol Technologies, Inc. Apr., 1992.

"Computer Data Authentication," Federal Information Processing Standards Publication 113, May 30, 1985.

"Die Einweg–Hashfunktion," Knapp, Funkschau, vol. 21 (1997), pp. 51–52.

"Die Suche nach dem Schlüssel," Schönleber, mc extra, vol. 4 (1995), pp. 30–33.

*Primary Examiner*—John Hilten
*Assistant Examiner*—Charles H. Nolan, Jr.
*Attorney, Agent, or Firm*—Hill & Simpson

[57] ABSTRACT

In a method for a digitally printing postage meter machine and for generating and checking a security imprint, critical franking information together with a signature are printed on a mail piece in the machine-readable area of the franking format. A print head having a standard printing width can be utilized for the imprint, which is human-readable and also reliably machine-readable, because the machine-readable information set to be printed is reduced by a modified public key method, with the private write key and the algorithm for encryption being stored at the postage meter machine site in a security device. The public read key and its certificate can be taken from a data base at the postal site, allocated to the postage meter machine identifier. The public key method modified for postage meter machines makes use of a simple key generation and encryption of the message at the postage meter machine site and a simple decrypting of the message at the postal site.

15 Claims, 5 Drawing Sheets

METHOD FOR OPERATING A DIGITALLY PRINTING POSTAGE METER TO GENERATE AND CHECK A SECURITY IMPRINT

BACKGROUND OF THE INVENTION

1. Field of the Invention

The invention is directed to a method for operating as a digitally printing postage meter machine so as to generate and check a security imprint.

2. Description of the Prior Art and Related Application

Postage meter machines can be especially efficiently utilized for franking mail pieces from a moderate to a high number of letters or other postal items to be sent. Differing from other printer devices, a postage meter machine is suitable for the processing of filled envelopes, even envelopes having very different formats. The printing width, however, is limited to the width of the franking imprint. When any of the "terms" letter or "mail piece" or "print carrier" is used below, this, of course, includes all kinds of envelopes or other recording media. Postal matter, file cards, labels or self-adhesive labels of paper or similar material can be employed as a recording medium.

Modem postage meter machines employ fully electronic digital printer devices. For example, the postage meter machine T1000, which is commercially available from Francotyp-Postalia, employs a thermal printing mechanism. It is fundamentally possible to print arbitrary texts and special characters in the postage stamp printing area with this device. The thermal transfer postage meter machine disclosed in U.S. Pat. No. 4,746,234 has a microprocessor and is surrounded by a protected housing which has an opening for the letter feeding. A mechanical letter sensor (microswitch) communicates a print request signal to the microprocessor relating to information about the position of the letter when it is fed. The microprocessor then controls the drive motors and a thermal transfer print head. An encoder communicates a signal derived from the inked ribbon transport of the thermal transfer to the microprocessor as information about the letter transport movement. The postage printing is done column-by-column.

German OS 196 05 014 discloses an embodiment of a printer device (JetMail®) that implements a franking imprint with an ink jet print head stationarily arranged in a recess behind a guide plate, given a non-horizontal, approximately vertical letter transport. Fully electronic digital printing is possible in non-contacting fashion with this device. A print sensor for recognizing the start of the letter is arranged shortly before the recess for the ink jet print head and interacts with an incremental sensor. The letter transport is possible without slippage due to pressure elements arranged on a conveyor belt.

A security system disclosed in U.S. Pat. No. 4,949,381 employs imprints in the form of bit maps in a separate marking field under the postage meter machine stamp. Although the bit maps are especially densely packed, the stamp image is reduced in height by the height of the marking field due to the size of the marking field that is still required. Too much of the printing area that could otherwise be used for advertizing slogan data or other data is thus lost. Of course, a high-resolution print head is relatively expensive. The high-resolution recognition means required for the evaluation of the marking is also disadvantageous.

Since the representation of a one-dimensional bar code or line code would require comparatively much space, an ID matrix code has also already been proposed. Another proposal was described in Technical Report Monograph 8, Symbol Technologies, April, 1992 and in European 439 682 and is directed to a PDF 417 symbolism.

The postal regulations usually define a width of about 1 inch for the franking field. Initial estimates yield a data storage possibility of a maximum of 400 bytes per square inch. Even if a print head and, a scanner were developed with corresponding resolution, this maximum dataset could not be achieved in the imprint in practice for the mail handling. The probability of scan errors increases with the amount of scanned data. Given higher printing resolution, a contamination of the letter surface can lead to an error, even without an electronic or scanning error. A certain redundancy of the data is therefore advantageous, but this reduces the number of usable bytes. A further disadvantage is that any bar code can only be checked by machine, i.e. it cannot be additionally manually checked. Consequently, about half the printing width (½ inch) would have to be made available for the conventionally, visually readable data. If the other half is then used for the machine-readable code, only 30 bytes, i.e. approximately 60 digits out of the total amount of information, can be reproduced in a reliably readable fashion, for example with the aforementioned JetMail®. Given a low print resolution, details are represented with less precision, and thus a lower number of digits can be represented.

In 1996, the U.S. Postal Service issued a request catalog with requirements made for the design of future, secure postage meter machines (information-based indicia program IBIP). It is suggested therein that specific data be cryptographically encoded and be printed on the letter to be franked in the form of a digital signature with reference to which the U.S. Postal Service can authenticate franking imprints. According to estimated particulars, an annual loss of approximately $200 million due to fraud is incurred by the U.S. Postal Service. Distinctions in these requirements have been made according to the type of franking means. Traditional postage meter machines, which usually only print a franking stamp (red), are referred to as "closed systems". Differing from such "closed systems" in PC franking systems, the corresponding letter address need not be incorporated into the crypto-encoding. When producing the letter, a letter recipient address (black) comprising the street address and a numerical code (zip to zone) can be printed on the cover with a standard printer. The recipient address, represented as a numerical code, is scanned with an optical character reader (OCR) in the mail centers and is printed onto the envelope in machine readable form as bar code (orange) for the mail distribution systems. Consequently, there is no link of the franking imprint to a specific letter recipient address. A potential counterfeiter, who does not frank at the postage meter machine but makes color copies of a letter having the same weight, will only be noticed within the postal system, i.e. in the post office, if all imprints are scanned and informationally stored in a data base, and if a comparison to all stored imprints is undertaken prove the uniqueness of the franking imprint, in order for the franking to be recognized as a valid original. The expenditure at the postal side for a complete archiving of all imprints and the implementation of a comparison under real-time conditions, however, would be enormous. When inspections at the postal side are only possible in the form of spot checks for expenditure reasons, there is a certain probability that a counterfeit will remain undetected.

European Application 660 270 discloses two measures for security, namely an evaluation method for identifying suspect postage meter machines in the data center that monitors the electronic recrediting, and a check of the mail pieces in the post office or in an institution authorized to carry out such a check. The possibility of producing unauthorized color copies can be at least limited in terms of time by employing time/date data as a monotonously continuously variable quantity, which is used to vary the printed data. A postage meter machine that exhibits odd behavior or irregularities, for example that has not had any contact with the data center for some time, is considered suspect. The data center reports suspicious postage meter machines to the postal authority, which then undertakes a targeted inspection of the mailings from that machine. A method and an arrangement for generating and checking a security imprint with a sequence of marking symbols is also disclosed. The graphics of the print format can be arbitrarily modified with a program modification of the postage meter machine. In addition to the traditional, visually readable data printed in open form, a sequence of marking symbols is also printed with the same print head, so that the print format can be manually checked by a postal employee, and can also be machine-interpreted. The print format can be modified as needed not only by insertable slogan text parts, but also by changing the marking from imprint to imprint due to the monotonously continuously variable quantity, thus making a mail piece printed in this way unmistakable. All critical data and the monotonously continuously variable quantity are compiled as a combination number and are then encoded and also subsequently converted into the aforementioned sequence of marking symbols. As a result, relatively little space is required for such a sequence of marking symbols compared, for example, to a bar code. By means of a suitable reader in one of the evaluation embodiments, the markings are automatically entered into a computer that is in communication with the data center. The marking is converted back into a crypto-number. Separately therefrom, traditional, visually (human) readable data printed openly are scanned with an OCR scanner in order to form a comparison crypto-number using a particular quantity, a computer in the postal system being informed of the quantity by the data center. The verification is done in the computer in the postal system by comparing the aforementioned crypto-number to the aforementioned comparison crypto-number. A recovery of franking information from the crypto-number is thereby no longer in the scope, and it is adequate when the marking allows a verification of the data printed on the mail piece. Given such a symmetrical encryption method, however, the encrypted message could fundamentally be encrypted by anyone who gains access to the same private key with which the message was encrypted.

Co-pending U.S. application Ser. No. 08/798,604 ("Method and Arrangement for Generating and Checking a Security Imprint"), filed Feb. 11, 1997 discloses a specific private key method for which the aforementioned evaluation embodiment that was additionally mentioned in European Application 660 270. The private key is stored in a secure data base at a verification location, which is typically present at the postal authority, and is thus kept secret. A data authentication code (DAC) is formed from the message, this corresponding to a digital signature. The data encryption standard (DES) algorithm disclosed in U.S. Pat. No. 3,962, 539 is thereby applied, this being described in FIPS PUB 113 (Federal Information Processing Standards Publication). The symbols of the marking symbol sequence of the digital signature are digits in the aforementioned co-pending application, possibly with additional special characters. The openly printed information and the digital signature in the OCR-readable section of the print format can thus be read visually (human) and by machine.

The best known asymmetrical crypto-algorithm is the RSA algorithm of U.S. Pat. No. 4,405,829, which was named based on the names of its inventors, R. Rivest, A. Shamir and L. Adleman. As is known, the receiver decrypts an encrypted message with a private key, this encrypted message having been encrypted at the transmitter with a public key. RSA was the first asymmetrical method that was also suitable for producing digital signatures. The RSA algorithm, however, like other digital signature algorithms (DSA), uses two keys, with one of the two keys being public. The implementation of the RSA algorithm in a computer, however, yields an extremely slow processing time and produces a long signature. Due to the length of the digital signature produced, an overly large imprint that digitally printing postage meter machines could not supply with a standard print head would be generated, even using a corresponding symbolism (ID matrix, PDF 417 and others).

A digital signature standard (DSS) has been developed that supplies a shorter digital signature and that includes the digital signature algorithm (DSA) of U.S. Pat. No. 5,231, 668. This development ensued proceeding from the identification and signature of the U.S. Pat. No. 4,995,085 and proceeding from the key exchange according to U.S. Pat. No. 4,200,770 or from the El Gamal method (El Gamal, Taher, "A Public Key Cryptosystem and a Singular Scheme Based on Discrete Logarithms", 1 III Transactions and Information Theory, vol. IT-31, No. 4, Jul. 1985). Such a secret, private key, however, is difficult to protect against theft from a computer.

Message authentification codes (MAC) can be generated with a symmetrical crypto-algorithm, and digital signatures for authentification can be generated with an asymmetrical crypto-algorithm. Given the symmetrical crypto-algorithm, the advantage of a relatively short MAC contrasts with the disadvantage of a single private key. Given the asymmetrical crypto-algorithm, the advantage of employing a public key contrasts with the disadvantage of a relatively long digital signature.

SUMMARY OF THE INVENTION

An object of the present invention is to provide a method for operating a digitally printing postage meter machine for checking a security imprint, wherein, while still assuring high security against manipulation and counterfeiting, public keys are employed and the quantity of information to be printed is reduced to such an extent that a print head for a printing width that is standard for frankings can be utilized for the printing. The imprint should also be machine-readable in a sub-section.

The franking data that are necessary for the inventive method are a machine-specific identifier, a monotonously continuously variable quantity and the franking value.

The identifier, which at least identifies the sender on the basis of the serial number of his machine, is internally stored in the postage meter machine. The monotonously continuously variable quantity (time or incremented piece number or other quantity) that is internally generated in the postage meter machine guarantees the uniqueness of each imprint. The franking value can be manually entered or can be calculated on the basis of a weight input or, for example, can be communicated to the postage meter machine from a postage-calculating scale. The aforementioned necessary franking information can be visually read by a human in a first section and are also printed unencrypted in a second section as machine-readable code. The specific demands for the franking information to be printed are prescribed by the postal authority or by private mail carriers. The security needs of the postal authorities thus have taken into consideration, but only the necessary franking data are processed in a suitable way in postage meter machines to form a digital signature that allows a verification of the franking imprints. The digital signature is composed of an encrypted message that is a component of the code that is printed machine-readable in the second section. The message is derived from at least the necessary franking data that are machine-readably printed in unencrypted form. The original data may possibly be subjected to a reduction of the data length to a predetermined length. Although the original data cannot be recovered from the digital signature following the reduction of the data length to a message having a predetermined length, the security against falsification of the necessary franking data printed in unencrypted form as machine-readable code in the aforementioned second section remains established given employment of an authentification.

Accordingly, the inventive method proceeds as follows.

An asymmetrical key pair is generated, comprising a private write key Kw and a public read key Kr. The private write key Kw and an asymmetrical encryption algorithm are stored in the postage meter machine in a postal security device (PSD), and the appertaining public read key Kr and its certificate are stored in a data base at the mail carrier site, allocated to the postage meter machine identifier.

The machine-readable data set to be printed contains a digital signature and unencrypted, critical franking information, the unencrypted critical franking information containing at least a postage meter machine identifier, the franking value and a monotonously continuously variable quantity that enter into the message.

The message is formed at the postage meter machine site, possibly with a reduction of the aforementioned critical franking data, and is then encrypted asymmetrically with the private write key Kw, before editing of data and generation of the print control signals for printing.

A modified public key method for generating the encrypted message is thereby installed in the postage meter machine in the form of a program, so that optimally little information is machine-readably printed on the letter. The private key is employed first in order to encode the message. The private key is referred to as the write key below. The encrypted message can in turn be decrypted with the public key. The public key thus need not be printed on the letter. The public key is referred to below as the read key. Advantageously compared to the private method, it is not private keys but only public keys that have to be administered in a data base. The read key and its certificate are stored in the data base of the postal authority. This data base need not be cryptographically secure since, of course, it at most contains only public keys. The identifier of the postage meter machine, which, of course, must be on every letter anyway, indicates a data element in the datafile of the data base of the postal authority in which the key resides together with its certificate. In addition to the certificate, other standard measures can be employed to preclude entry of a counterfeit key into this data base. To this extent, the data base need only meet a lower security demand, that is currently already standard in conventional computer systems. Additional security measures that would be necessary given administration of private keys can be omitted.

The following steps are provided for checking the security imprint at the mail carrier site.

The postage meter machine identifier is extracted from the scanned, unencrypted, critical franking information at the mail carrier site and is entered into a data base, with a stored, public read key Kr and its certificate being allocated to the postage meter machine identifier in the data base. The validity of the read key Kr is checked with reference to its certificate, and the public read key Kr stored in the data base is then employed for the asymmetrical deciphering.

A verification is implemented on the basis of a message formed by the asymmetrical deciphering as well as on the basis of a message formed by reduction of the scanned, unencrypted, critical franking information.

The data base which is present at the postal authority can be utilized for the verification process in order to check the imprints of all postage meter machines for uniqueness. This is true regardless of the specifically employed algorithm that was established between the manufacturer of the postage meter machine and the postal authority. A further data element exists in the aforementioned datafile in order to identify the type of crypto-algorithm employed. In the verification process, the computer of the evaluation system at the postal authority fetches the correct read key from the data base, decrypts the digital signature to form a message, and then implements the verification on the basis of this message. To that end, a comparison message is formed from the unencrypted information, such as identifier piece number and franking value printed as machine-readable code, that is likewise scanned. The same algorithm as in the formation of the comparison message in the evaluation means after the scanning is applied in the formation of the message in the postage meter machine before the printing. The message can then be encrypted via a suitable, asymmetrical crypto-algorithm.

A specific asymmetrical crypto-algorithm that generates a significantly shorter digital signature than for example, RSA or digital signature standard (DSS) is utilized in an especially advantageous embodiment of the method.

The aforementioned problems in conjunction with the security imprint that occur in postage meter machines that employ print heads with a lower printing resolution or that occur in the checking of the security imprint at the postal authority are thereby solved at the same time.

DESCRIPTION OF THE PREFERRED EMBODIMENTS

Figure 1:
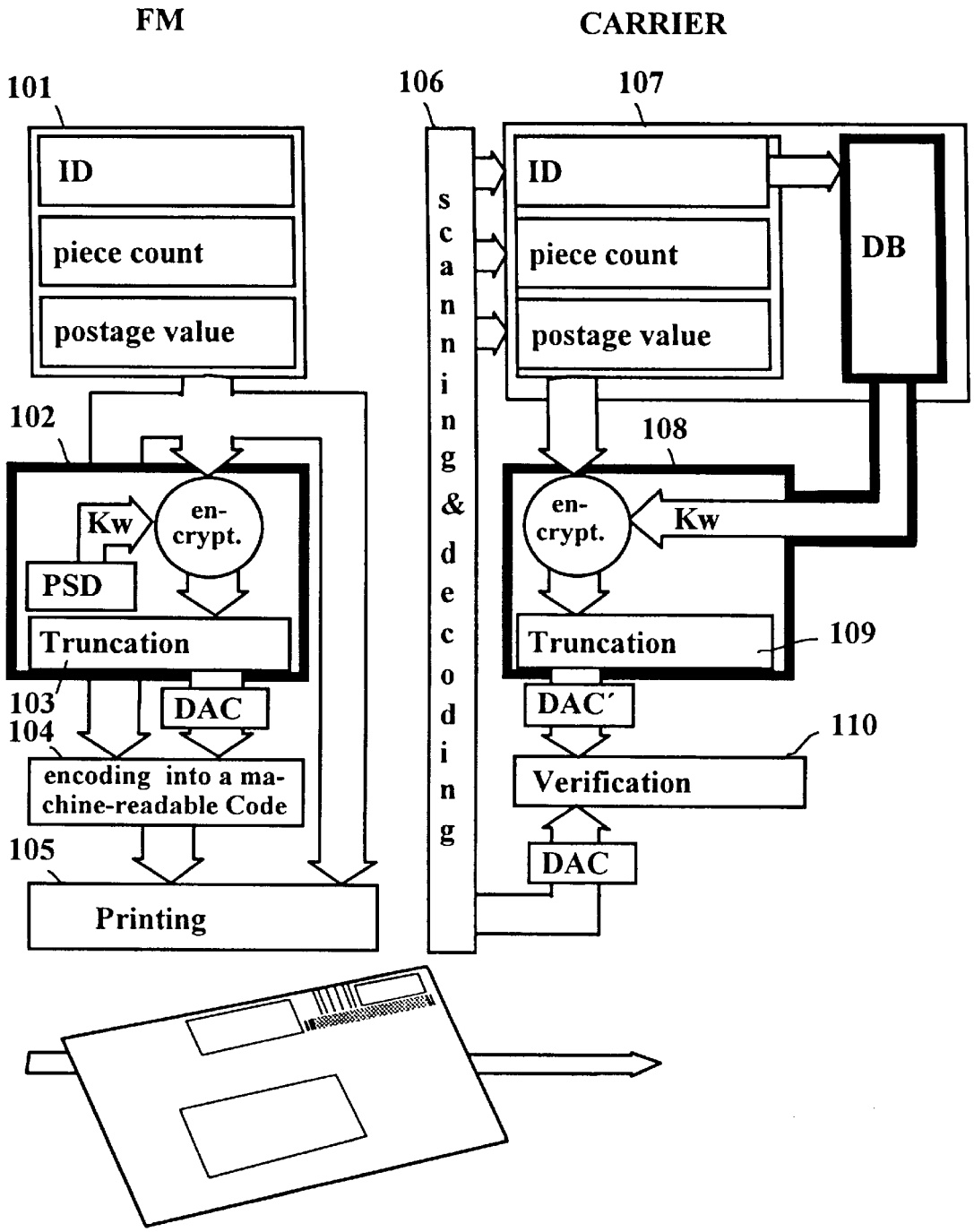
FIG. 1 is a flowchart of the private key method modified for a machine-readable code.

FIG. 1 shows the flowchart of the private key method that requires secrecy for the key.

The limited printing area and obtainable resolution oppose efforts to incorporate further data in the encryption. Merely for reasons of space, thus, it would not be possible without further difficulty to meet the IBIP demands by replacing the marking symbol or number sequence with the required PDF 417 code. Since the original franking information no longer have to be derived from encrypted message, however, the message can be truncated further down to one digit. The amount of data to be printed is thus reduced to the openly printed information and the digital signature, which can now likewise be printed machine-readable as PDF 417 symbols. The openly printed information are at least an identifier, a piece counter and the franking value. The identifier comprises the manufacturer's identification numbers and those of the apparatus (serial number of the machine). The key still would have to be kept secret even in such a modified private key method, making high security demands on the data base and its administration.

The necessary franking information, preferably the identifier, piece number and the franking value, are edited in a step 101. A DES encryption is undertaken in the step 102 with the private key Kw to form encrypted franking information. A truncation to form a data authentification code DAC can ensue in step 102 as well or subsequently in the step 103. The unencrypted, necessary franking information together with the DAC are encoded in the step 104 according to the symbolism selected (for example, PDF 417), and are then printed on a mail piece together with the visually (human) readable data when franking in the following, step 105. After conveying the letter to the carrier, the machine-readable section of the franking imprint is scanned in a step 106, and a decoding of the scanned symbols of the imprint subsequently ensues. The franking information (identifier, piece number, franking value) and the data authentfication code (DAC) are then present in an appropriate form that the computer at the postal site can further-process. In the step 107, an entry from the identifier is sought in a cryptographically secure data base that contains the private key Kw. In the step 108, a DES encryption of the necessary franking information is undertaken with the private key Kw, and a truncation to form a reference data authentification code DAC' is undertaken in this step as well or in a following, step 109. In the step 110, the data authentification code DAC recovered from the scanned and decoded PDF 417 imprint in the step 106 is compared to the reference data authentification code DAC' determined in the steps 108 and 109. The validity, i.e. a properly debited franking value, is decided based on the equality. The known cipher block chaining (CBC) mode can also be utilized, for example, as DES encryption of longer datasets to form franking information.

Figure 2:
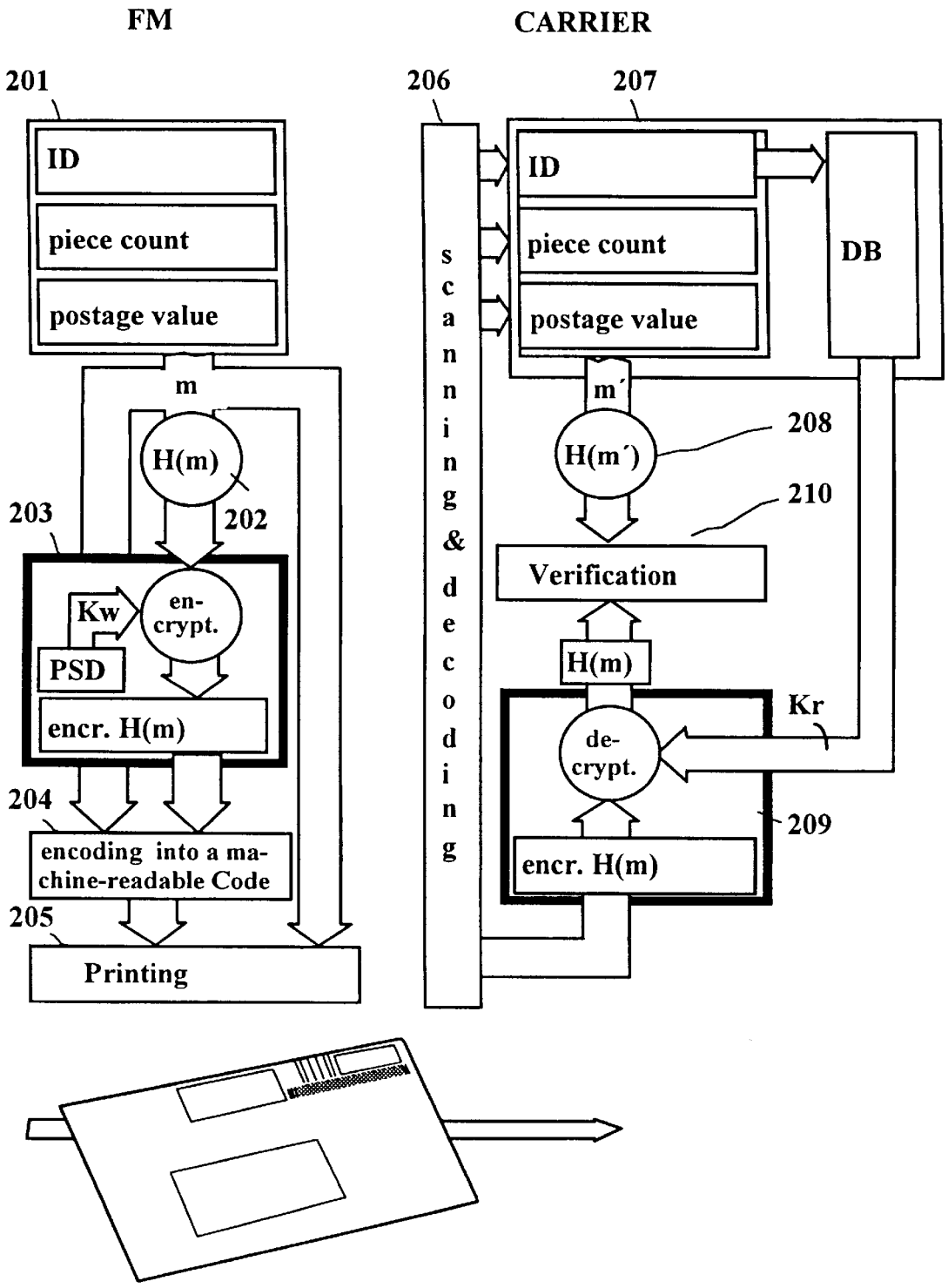
FIG. 2 is a flowchart of the public key method inventively modified for a machine-readable code in accordance with the invention.

FIG. 2 shows the flowchart of the inventively modified public key method. The necessary franking information, preferably the identifier, piece number and the franking value, are edited as dataset m in a step 201. A message is generated by data reduction in the step 202. A hash function H(m) can be utilized for this purpose. In the step 203, an encryption to form an encrypted message encr.H(m) is undertaken with the private write key Kw. In the step 204, the unencrypted, necessary franking information together with the encrypted message encr.H(m) are converted into a code (for example, PDF 417) that is printed onto a mail piece together with the visually (human) readable data when franking in the step 205. A generation of the print format with electronic embedding of the variable data ensues in the step 205 before the franking. After delivering the mail to, or receipt of the mail at, the mail carrier, the machine-readable section of the franking imprint is scanned in a step 206, and a code conversion from the machine-readable code (PIF 417) is undertaken to form the unencrypted dataset m' and the encrypted message encr.H(m), that is intended to document the validity of the scanned, unencrypted dataset m'. In the step 207, an entry from the scanned identifier is sought in a postal data base that contains the public read key Kr. In the step 208, a data reduction of the dataset m' analogous to the step 202 at the postage meter machine site is implemented at the postal site to form a message H(m'), the dataset m' being derived from the scanned data. In the step 209, a deciphering of the encrypted message encr.H(m) is undertaken with the read key Kr to form the original dataset. In the step 210, the signature scanned in the step 206—which was converted back to the encrypted message encr.(m) and then deciphered to form the message H(m)—is compared to the message H(m') determined in the step 208. The validity, i.e. a properly debited franking value, is decided from the equality. A counterfeit is suspected given inequality. A specific algorithm that supplies a relatively short signature is preferred for the asymmetrical encryption.

Given application of a public key or asymmetrical method, two keys that are not the same exist as a key pair: the write key Kw and the read key Kr. The write key Kw is secret and the read key Kr is public. In order to prevent someone from generating a Kw/Kr key pair without authorization, the read keys Kr are provided with a certificate assigned by the postal authority. As a result, the postal authority can check whether the read key Kr found in the data base is genuine. Here, the central differences compared to the private key method are 1. the non-private read key Kr is stored in the data base together with the certificate, and
2. the digital signature encr.H(m) is not truncated since, of course, it must in turn be decrypted in a later step in order to recover the message H(m) with which the comparison is implemented in the verification.

The original data relating to the necessary franking information are reduced with a hash function H to form a message H(m), i.e. are converted into a binary string with a uniformly fixed length, for example 64 bits. A checksum could be used as an alternative to such a hash function. A private key is thus not required. Such hash functions are unidirectional, unambiguous functions and are not to be confused with similar functions that utilize a private key such as, for example, message authentication codes (MACs), cipher block chaining (CBC) mode or the like.

The message can then be encrypted via a suitable, specific asymmetrical cryptoalgorithm that produces a relatively short digital signature. The El. Gamal method (ELG) is advantageously employed. The ELG method is based on the difficulty of calculating discrete logarithms, i.e. the value x, a known base g, and a p module prime number when (p−1)/2 is likewise a prime number. Three numbers, i.e. the remainder y, the base g and the modulo p, that form the public key stand in the mathematical equation $$y=g^x \bmod p \qquad (1).$$

The private key x (with x<p) is the discrete logarithm of y to the base g with respect to the modulo p. An N-bit long prime number is selected for generating the key. For example, when N=64 bits applies, this would be a 20-place prime number.

The public read key Kr=f{y,g,p} is stored in a data base at the postal site together with a certificate in a manner allocated to the manufacturer number (vendor ID) and machine number (device ID). The latter proves the genuineness of the public read key Kr. A postage security device (PSD) at the postage meter machine site supplies the private write key Kw and preferably also undertakes the encryption with the suitable, specific asymmetrical crypto-algorithm.

Since the digital signature that arises is about twice as long as the clear text m, the latter is subjected to a reduction by, for example, forming the (horizontal) checksum of the clear text, this possibly being subjected to a truncation. Alternatively, other suitable h-functions can also be utilized. After the formation of a dataset H(m), a secret value k<p is formed, whereby k is relatively prime with respect to p−1. The two numbers a and b are calculated for the dataset H(m):

$$a=g^k \bmod p \tag{2}$$

and $$b=y^k\, m \bmod p \tag{3}$$

The microprocessor or ASIC of the PSD is programmed such that the secret value k can then be deleted. The two numbers a and b form two encrypted blocks A and B, each with the respective length N=64 bits, i.e. the digital signature encr.H(m) is the sum and has a length=16 bytes.

The clear text m is 18 digits long (vendor ID=1 digit, device ID=7 digits, postage amount=5 digits, piece count=5 digits), whereby each digit can be represented with 4 bits. Nine bytes of machine readable text thus arise. Together with the digital signature, a minimum of 25 bytes arises, which can already be comfortably presented with PDF 417 and an error correction level of 2 in a machine-readable area of about 60 mm·10 mm. Even a prime number having double the bit length still yields a machine-readable text that fits in the aforementioned area, presuming that the resolution is adequately high when printing and scanning.

The digital signature printed on the letter and the unencrypted machine-readable data are scanned and converted by decoding into a digital binary or hexadecimal form that can be easily further-processed in the evaluation system.

For deciphering, the extracted digital signature encr.H(m) is resolved into two N-bi blocks. For two successive blocks A, B, the equation (4) is solved for m' with the generalized Euclidean algorithm:

$$a^x\, m'=b \bmod p \tag{4}$$

The following applies:

$$a^x\, m=g^{kx}\, m'=g^{xk}\, m'=y^k\, m'=b \bmod p \tag{5}$$

Since $$y^k m=b \bmod p \tag{6}$$

applies, the equality of m=m' can be decided by comparing the values from Equations (5) and (6).

Another suitable crypto-algorithm can also be alternatively employed if allowed by the resolution of the print format. For example, an elliptic curve algorithm (ECA) can be employed. The practicality of elliptic curve crypto-systems has been improved since the mid-80's, when elliptic curve crypto-systems that were still impractical then were proposed by Victor Miller (Miller, Victor, Use of Elliptic Curves in Cryptology, in H. C. Williams (ed.), Proceedings of Crypto '85, LNCS 218, Springer, Berlin 1986, pp. 417–426) and, independently, by Neal Koblitz (Koblitz, Neal, Elliptic Curve Cryptosystems; Mathematics of Computation, Vol. 48, No. 177, January 1987, pp. 203–209). In the meantime, a 160-bit key of an elliptic curve crypto-system delivers an identical security level as a 1024-bit key of a digital signature system such as, for example, RSA that is based on the complexity of the factorization problem. An ELG-based elliptic curve signature strategy (ECSS) is also described in the standard IEEE P1363. This can work with considerably shorter keys than, for example, a system based only on the ELG method. The calculating outlay for generating a signature according to an ELG based elliptic curve signature strategy (ECCS) is, in particular, lower then when based on the RSA method. The efficiency advantage for signature systems based on elliptical curves increases noticeably for longer key lengths since no sub-exponential algorithm has yet become known for the solution of the discrete logarithm problem on elliptical curves.

The message can likewise be encrypted via another, suitable, specific asymmetrical crypto-algorithm that uses other, suitable mathematical equations for a signature system based on elliptical curves.

The drastic reduction of the information to be printed that can thus be achieved compared to the normal asymmetrical public key method even allows the employment of the PDF417 code in order to print at least the digital signature in a reliably machine-readable form. The common printing of the openly printed information and of the digital signature can ensue with a print head at the printing width that is standard for postage meter machines.

Figure 3A:
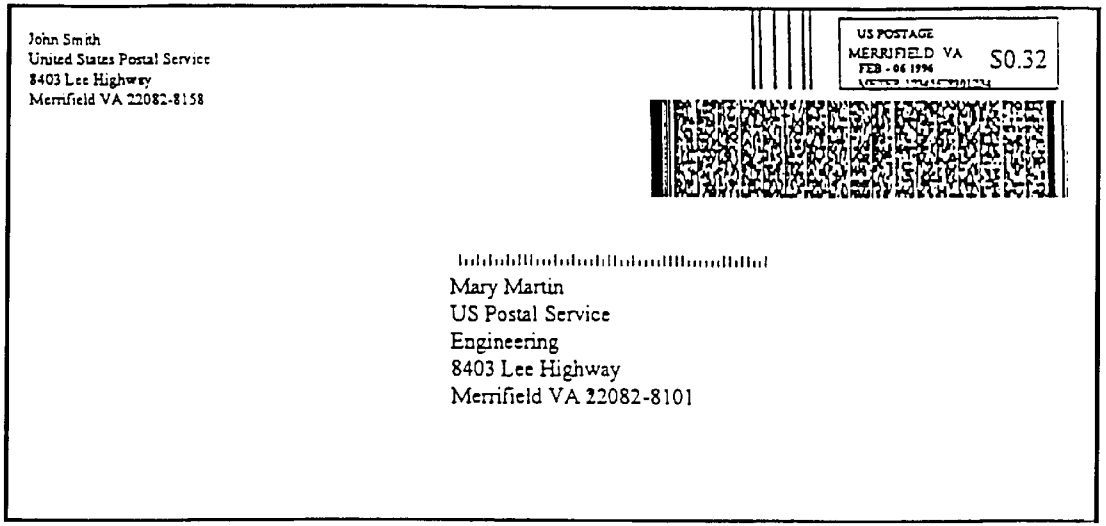
FIGS. 3*a* and 3*b* respectively show examples of franking imprints for PDF 417 using RSA and the elliptic curve algorithm ECA.

It can be clearly seen from FIG. 3*a* that the franking imprint produced by applying the RSA method requires a larger printing width than in the case of the inventive method.

Figure 3B:
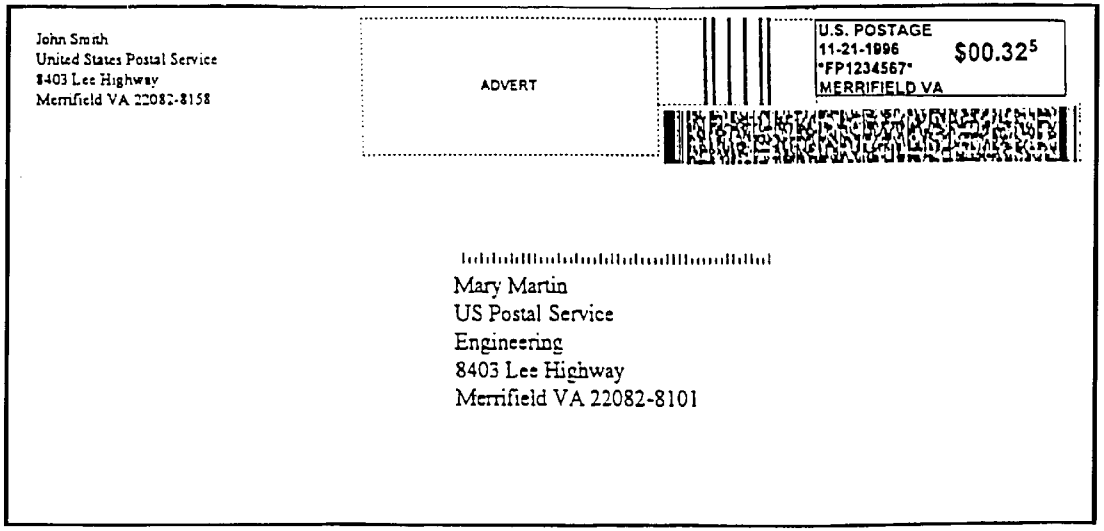

FIG. 3*b* shows a franking imprint generated according to the inventively modified public key method. The printing width can be smaller compared to the franking imprint (shown in FIG. 3*a*) producing using the RSA method. The visually (human) readable region and a region for the FIM code according to the postal regulations are arranged the machine-readable region. A further printing region, which preferably can be employed for printing an advertizing slogan, lies to the left thereof. Due to the FIM code, a visually (human) readable region about 11 through 14 mm wide arises. The remaining width therefore can be employed for the machine-readable region. Due to the data base that administers the read key with the appertaining certificate, the latter need not be co-printed in the machine-readable region of the imprint.

Alternatively, of course, a franking imprint having a similar appearance can be generated with the modified private key method, as shown in FIG. 3*b*. The counterfeit protection, however, is highly dependent on the truncation and is not as great as in the case of the inventively modified public key method. The advantage of the inventively modified public key method of FIG. 2 can clearly be seen from the comparison of the two FIGS. 1 and 2 because the region (bold black boundary) to be made secure is smaller therein and, for example, can be implemented as a fast hardware circuit (ASIC) that is more secure from invasion than a purely software solution.

The data base that administers the read keys need not be additionally protected against the electronic detection of these keys. As a result, it becomes possible to employ a distributed data base, i.e. largely local data bases with the keys for the reported postage meter machines, whereby the data bases can exchange data with one another.

Figure 4:
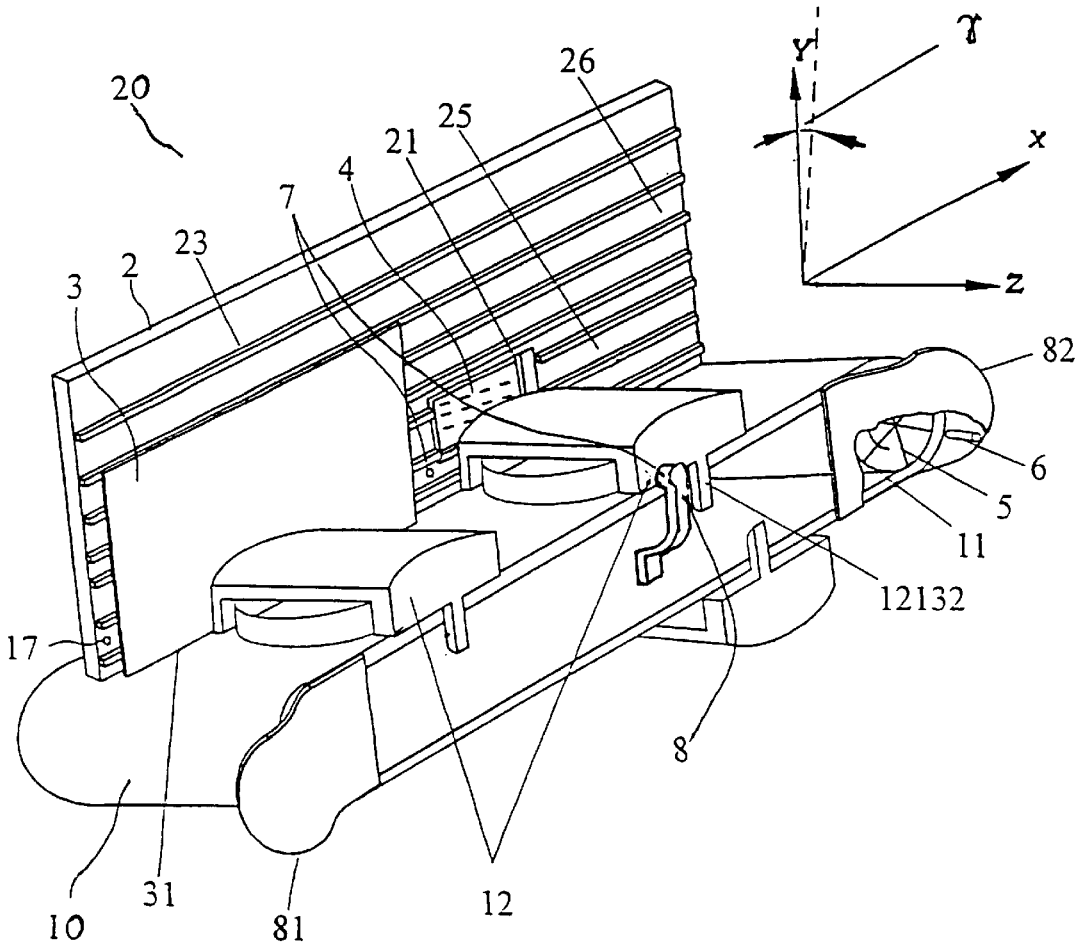
FIG. 4 shows details of an inventively operating printer of a postage meter machine.

FIG. 4 shows details of an inventively operating printer means for printing an envelope 3 standing on an edge 31. The printer includes conveyor belt 10, a guide plate 2 arranged orthogonally above the transport plane (XZ-plane) in the XY-plane, and an ink print head 4. The envelope 3 is turned over and rotated such that a surface thereof lies against the guide rails 23 of the guide plate 2. The guide plate 2 is preferably inclined by an angle γ=18° relative to the perpendicular. The guide plate 2 and the conveyor belt 10 describe an angle of 90° with one another. The envelope 3 standing on the conveyor belt 10 necessarily lies against the guide plate 2 due to the oblique attitude thereof and is also pressed by pressure elements 12 that are secured to the conveyor belt 10. When the conveyor belt 10 moves, the letter 3 (actually a series of letters 3)—entrained by the pressure elements 12—slides along the guide rails 23 of the stationary guide plate 2. A continuation 12132 of the pressure elements 12 thereby slides on a connecting link with deflections 81 or 82 and enables the pressing or release of the envelope 3 before or after the printing. A recess 21 for the ink print head 4 is provided in the guide plate 2. Downstream in the conveying direction, the guide plate 2 is set back relative to the seating surface for the letter 3 in the region 25 behind the recesses 21 to such an extent that the printed surface is sure to lie free. The respective sensors 17 or 7 arranged in the guide plate 2 serve the purpose of preparation or recognition of the start of the letter 3 and triggering printing in the conveying direction. The conveyor means is composed of a conveyor belt 10 and two rollers 11. One of the rollers 11 is a drive roller equipped with a motor 15. Both rollers 11 are preferably implemented (in a way not shown) as toothed rollers; correspondingly, the conveyor belt 10 is also implemented as a toothed belt, which achieves an unequivocal force transmission. An encoder arrangement is coupled to the drive roller 11. The drive roller 11 together with an incremental encoder 5 is preferably seated firmly on a shaft, which can not be seen. For example, the incremental encoder 5 is implemented as a slotted disk that interacts with a light barrier 6.

Figure 5:
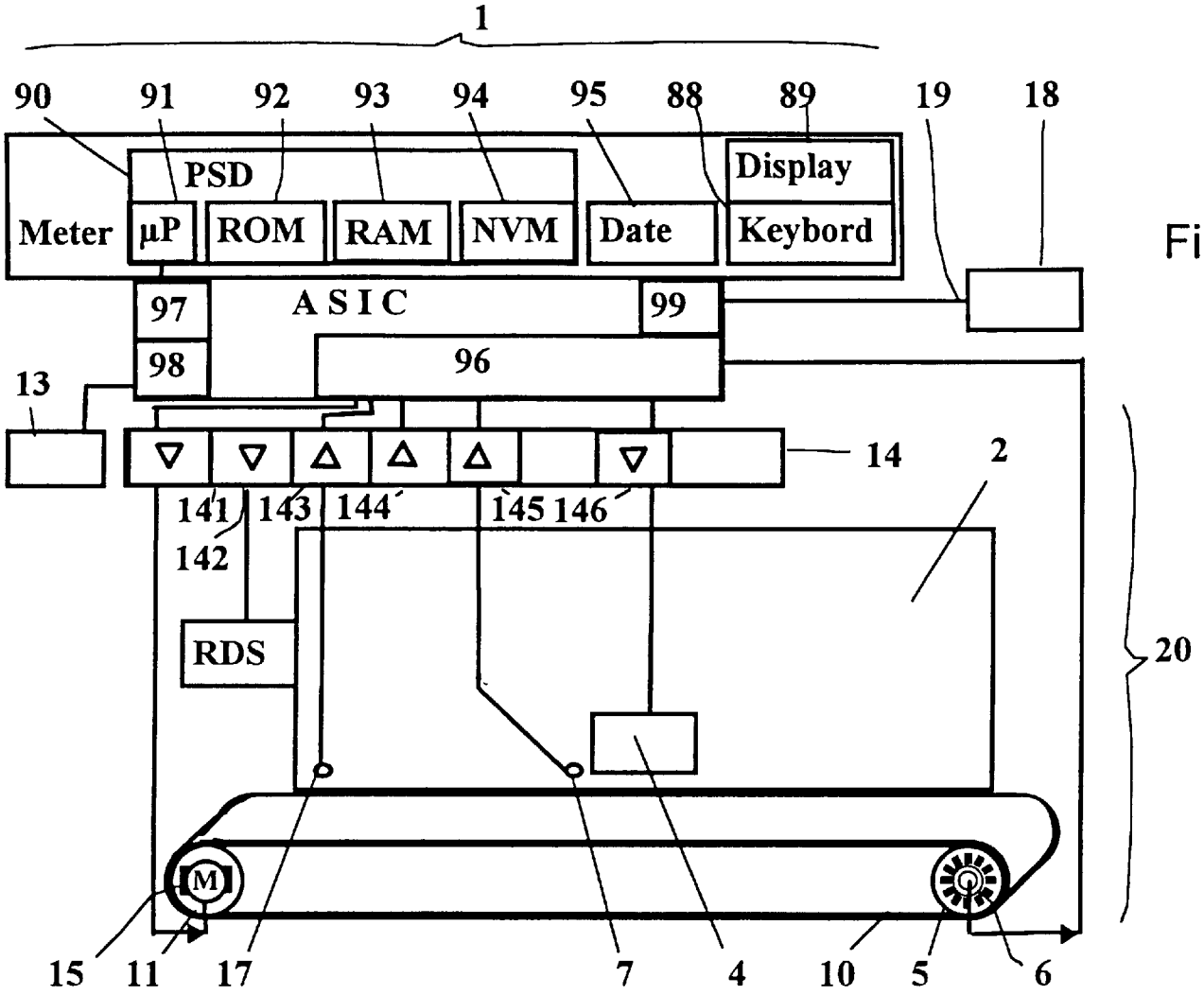
FIG. 5 is a block circuit diagram relating to the drive of the inventively operating printer.

FIG. 5 shows a block circuit diagram relating to the drive of the printer system 20 with a control system 1. The control system 1 includes a meter with a postal security device PSD 90 having a date circuit 95, having a keyboard 88 and having a display unit 89 as well as an application-specific circuit ASIC. The postal security device PSD 90 is composed of a microprocessor 91 and of known memories 92, 93, 94 that are accommodated together in a secured housing. The program memory ROM 92 also contains an encryption algorithm and the private write key Kw. Alternatively, the microprocessor can be fashioned as an OTP (one-time programmable) processor that stores the program for the encryption and the private write key Kw.

The postal security device PSD 90 can also contain a hardware accounting circuit. The accounting functions alternatively can be implemented by software. Further details may be found, for example, in European Application 789 333.

The postal security device PSD 90 can also be fashioned as a security module SM specifically for a personal computer that controls a postage meter machine base. Further details are provided in German Application 197 11 998.0.

The application-specific circuit ASIC of the control system 1 includes an interface circuit 97 and is in communication with the microprocessor 91 via the interface circuit 97. The ASIC also contains the appertaining interface circuit 96 to the interface circuit 14 located in the machine base, and produces at least one connection to the sensors 6, 7, 17 and to the actuators, for example to the drive motor 15 for the roller 11, and to a cleaning and sealing station RDS for the ink jet print head 4, as well as to the ink jet print head 4 of the machine base. The fundamental arrangement and interaction between ink jet print head 4 and the RDS is described in German Application 197 26 642.8.

Advantageously, the print sensor 7 is fashioned as a transmitted light barrier. For example, a transmission diode of the transmitted light barrier of the print sensor 7 is arranged in the guide plate 2, and a reception diode of the transmitted light barrier is arranged at a distance therefrom corresponding to the maximum thickness (in Z-direction) of the pieces of mail (letters). For example, the reception diode is secured to a carrier plate 8 at the connecting link. A reversed arrangement with reception diode in the guide plate 2 and transmission diode at the carrier plate 8 would be just as effective. The start of the letter (edge) is always exactly detected in the same way given thin as well as thick letters. The print sensor 7 supplies the start signal for the path control between this sensor 7 and the first nozzle of the ink jet print head. The print control ensues on the basis of the path control, whereby the selected stamp offset, that is entered by keyboard 88 and is non-volatilely stored in the memory NVM 94, is taken into consideration. A planned imprint is the stamp offset (without printing), the franking print format and, possibly, from further print formats for an advertising slogan, shipping information (selective imprints) and additional, editable messages.

The individual print elements of the print head 4 are connected within its housing to a print head electronics, and that the print head can be driven for a purely electronic printing. The encoder 5,6 supplies a signal to the microprocessor 91 per n printing columns. This occur by an interrupt function. A belt counter that retains the motion progress of the motor 15 and, thus, of the conveyor belt 10 is also updated at every interrupt. Each printing column is preferably 132 $\mu$m wide. The belt counter can be a two-byte counter, i.e. $2^{16}-1$ counter readings are possible. A maximum letter travel path of $W_{max}=65535*132\ \mu m*n$ can thus be covered.

A letter evaluation routine is initiated with the preparation sensor 17. The preparation sensor 17 detects the leading edge of a letter 3, this being registered by the microprocessor 91 in order to start the belt counter, which adds the encoder pulses until the leading edge of the letter 3 reaches the print sensor 7. The aggregate pulse count is compared to the pulse count corresponding to the distance between the preparation sensor 17 and the print sensor 7. The allowable deviation for the first, defined letter travel path $W_{def1}$ amounts to 10%. The print control or sensor inquiries are thus all path-controlled. The print control ensues for an imprint which is printed column-by-column, whose printing columns are at a predetermined angle $10° \leqq \alpha \leqq 90°$ relative to the conveying direction.

The visually and the machine-readable variable print format data are electronically embedded into the other fixed or semi-variable print format data and are printed column-by-column. A suitable method which can be employed is described for example, in European Application 762 334.

FIG. 5 also shows a further interface circuit 99 that is connected toward the right via a data cable 19 to an interface circuit 18 of the deposit station, which follows downstream and allows the control thereof by the control system 1. Another peripheral device to the left of the postage meter machine base, formed by the control system 1 and printer system 20, is preferably an automatic delivery station 28 and has an interface system 13 connected via cable 16 to an interface circuit 98 of the ASIC. Further sensors can be arranged in these further stations for detecting the letter edges, these being coupled via the interfaces to the microprocessor 91 in the control system 1 in order to enable or to monitor the system operation.

A modified embodiment for a number of periphery devices (stations) suitable for the periphery interface is described in German Application 197 11 997.2.

The control system 1 and the printer system 20 can also be realized differently from the embodiment described herein. The invention is not limited to the present embodiment since further, other embodiments of the invention can be developed proceeding from the disclosed basic idea of the invention Although various minor modifications might be suggested by those skilled in the art, it should be understood that I wish to embody within the scope of the patent warranted hereon all such modifications as reasonably and properly come with the scope of my contribution to the art.

I claim as my invention:

1. A method for operating a postage meter machine for generating a security imprint, said postage meter machine having a digital printer which prints franking information together with a signature on a mail piece in a machine-readable region of a franking format, said franking format having a standard printing width for printing on a print medium surface of a mail piece being transported past said printhead, and control means for generating print control signals for causing said digital printer to print said franking information, said method comprising the steps of:

generating an asymmetrical key pair comprising a private write key and a public read key;

storing said private write key and an asymmetrical encryption algorithm in said postage meter machine in a postal security device;

storing said public read key and a certificate associated therewith in a memory location in a data base at a mail carrier site, said memory location being allocated to a postage meter machine identifier;

formatting machine-readable information, to be printed by said digital printer in said machine-readable region of said franking format, containing a digital signature and unencrypted necessary franking information, said unencrypted necessary franking information including at least said postage meter machine identifier, a franking value, and a monotonously continuously variable quantity incorporated in said machine-readable information; wherein said digital signature is generated by encrypting said unencrypted necessary franking information with said private write key before generating said print control signals to obtain an asymmetrically encrypted message having a security level associated therewith said digital signature having fewer bits than an RSA digital signature of a comparable security level, and printing said asymmetrically encrypted message with said digital printer.

2. A method as claimed in claim 1 comprising the additional step of reducing said necessary franking information before asymmetrically encrypting said machine-readable information.

3. A method as claimed in claim 2 wherein the step of reducing said necessary franking information comprises applying a hash function to said necessary franking information.

4. A method as claimed in claim 1 comprising employing a modified ELGamal method as said asymmetrical encryption method.

5. A method as claimed in claim 1 comprising employing a modified elliptic curve method as said asymmetrical encryption method.

6. A method as claimed in claim 1 comprising the additional step of encoding said machine-readable information in a mnachine-readable code before printing said machine-readable information.

7. A method as claimed in claim 1 comprising the additional step of encoding said machine-readable information in a machine-readable symbolism before printing said machine-readable information.

8. A method as claimed in claim 7 comprising employing a PDF 417 symbolism as said machine-readable symbolism.

9. A method for checking a security imprint on a mail piece, said security imprint comprising machine-readable information containing necessary franking information including at least a postage meter machine identifier, said method comprising the steps of:

scanning said machine-readable information at a mall carder site and extracting said postage meter machine identifier therefrom;

storing a public read key and an associated certificate at a data base at said mail carrier site at a memory location respectively allocated to a postage machine identifier;

comparing the postage meter identifier extracted from the scanned machine-readable information with the postage machine identifier stored in said data base and checking the validity of the read key, with reference to said certificate, associated with the stored postage machine identifier corresponding to the scanned postage machine identifier;

employing said public read key stored in said data base, associated with the stored postage meter machine identifier corresponding to the scanned postage meter machine identifier, for asymmetrically decrypting said security imprint; and verifying said security imprint by forming a message from said asymmetrical deciphering and by forming a message by reduction of scanned, unencrypted necessary franking information.

10. A method as claimed in claim 9 wherein the scanned signatures a matrix code which is decoded before said asymmetrical deciphering, and wherein a data reduction is undertaken by applying a hash function to said necessary franking information.

11. A method for operating a digitally printing postage meter machine for generating and checking a security imprint, comprising the steps of:

offering necessary franking information as a data set;

generating a message by data reduction;

asymmetrically encrypting said message using a private write key to form an encrypted message;

converting unencrypted necessary franking information together with said encrypted message into a matrix code;

generating a print format in a postage meter machine by electronically embedding variable data in said franking information to produce machine-readable data and human-readable data which are printed onto a mail piece by said digital printhead;

delivering said mail piece to a mail carrier and, at said mail carrier, scanning said mail piece and conducting a code conversion from said matrix code to recover said unencrypted data set and said encrypted message, said unencrypted data set including a scanned identifier;

storing a plurality of stored identifiers, each respectively allocated to a public read key, in a data base at said mail carrier;

matching said scanned identifier to a stored identifier in said data base and retrieving the public read key associated with the stored identifier which matches said scanned identifier;

conducting a data reduction of said unencrypted data set to obtain a data-reduced message;

decrypting said encrypted message using the retrieved public read key to recover said data set; and comparing a signature scanned at said mail carrier to said data-reduced message and confirming validity of said data-reduced message given equality with said signature.

12. A method as claimed in claim 9 wherein said necessary franking information comprise a postage meter machine identifier, a piece number and a franking value.

13. A method as claimed in claim 9 wherein said asymmetrical encryption has a security level associated therewith said method comprising employing an algorithm which generates a short digital signature for said asymmetrical encryption having few bits than an RSA signature of a comparable security level.

14. A method as claimed in claim 9 comprising using a machine-readable code for generating said machine-readable data.

15. A method as claimed in claim 14 comprising employing a PDF 417 symbolism as said machine-readable code.

* * * * *